US010882108B2

(12) United States Patent
Yeo

(10) Patent No.: US 10,882,108 B2
(45) Date of Patent: Jan. 5, 2021

(54) SYSTEM OF NON-CRUSHING FOR CASTING

(71) Applicant: JPS CO., LTD., Gimhae-si (KR)

(72) Inventor: Dong-Hoon Yeo, Gimhae-si (KR)

(73) Assignee: JPS CO., LTD., Gimhae-si (KR)

( * ) Notice: Subject to any disclaimer, the term of this patent is extended or adjusted under 35 U.S.C. 154(b) by 0 days.

(21) Appl. No.: 16/434,876

(22) Filed: Jun. 7, 2019

(65) Prior Publication Data

US 2020/0055114 A1 Feb. 20, 2020

(30) Foreign Application Priority Data

Aug. 14, 2018 (KR) ..... 10-2018-0094846

(51) Int. Cl.
*B22D 45/00* (2006.01)

(52) U.S. Cl.
CPC ..... *B22D 45/00* (2013.01)

(58) Field of Classification Search
CPC ..... B22D 45/00; B22D 5/02; B22D 5/04
See application file for complete search history.

(56) References Cited

U.S. PATENT DOCUMENTS 1,472,623 A * 10/1923 Acton ..... B22D 5/04 164/329

FOREIGN PATENT DOCUMENTS

| | | |
|---|---|---|
| KR | 10-1587280 B1 | 1/2016 |
| KR | 10-1739510 B1 | 5/2017 |
| KR | 10-1754067 B1 | 7/2017 |

* cited by examiner

*Primary Examiner* — Kevin P Kerns
*Assistant Examiner* — Steven S Ha
(74) *Attorney, Agent, or Firm* — Maschoff Brennan

(57) ABSTRACT

The present invention relates to a non-crushing casting system including mold units for receiving a molten material from a melting furnace and casting the molten material to form a plurality of unit shape materials having a predetermined size; and a conveyor unit for performing infinite looping of mold units to detach the unit shape materials of the cast molten material, and for conveying and discharging the detached unit shape materials. According to the present invention, to manufacture a subsidiary raw material for steel manufacture having a certain unit size, ferromanganese or ferrosilicon is melted, and then cast in molds having a predetermined size.

9 Claims, 7 Drawing Sheets

SYSTEM OF NON-CRUSHING FOR CASTING

TECHNICAL FIELD

The present invention relates to a non-crushing casting system, and more particularly to, a non-crushing casting system capable of manufacturing a subsidiary raw material for steel manufacture having a certain unit size by melting ferromanganese or ferrosilicon and casting the melted ferromanganese or ferrosilicon in molds having a predetermined size.

BACKGROUND ART

The quality of a ferroalloy, which is a steel product, greatly depends on the content of subsidiary raw materials added in a manufacturing process.

Conventionally, when subsidiary raw materials are used to manufacture a ferroalloy, subsidiary raw materials are mixed, dissolved in a melting furnace, solidified in a casting deck, and subjected to natural cooling. Thereafter, a process of finely crushing the naturally cooled lumps is performed. In this process, irregular particles and dust are generated, thereby causing environmental pollution and resulting in loss of raw materials corresponding to the amount of the generated dust.

Technical attempts have been made to solve these problems. As a result, in the manufacture of ferromanganese, a process in which casting, cooling, and crushing processes are incorporated has been developed.

Patent Document 1 (Korean Patent No. 10-1739510, "STONE MOLD FOR PIG CASTING MACHINE") is associated with the above described technical attempts.

Patent Document 1 discloses a stone mold for a pig casting machine including a belt, which is circulated in a closed-loop circulation manner by first and second strokes spaced apart from each other; a mold holder as a stone mold be mounted on a pig casting machine for casting paddle-type additives; and a mold part which is accommodated in the mold holder and in which a plurality of cavities is formed, wherein the mold part includes a stone material.

Patent Document 2 (Korean Patent No. 10-1587280, "FERROSILICON CASTING APPARATUS") is another related document.

Patent Document 2 provides a ferrosilicon casting apparatus capable of adding most of ferrosilicon during a steel manufacturing process.

Patent Document 2 discloses a ferrosilicon casting apparatus for casting ferrosilicon used as an additional material in a steel manufacturing process, the ferrosilicon casting apparatus including a distributor for receiving molten ferrosilicon through a hot water heater and uniformly distributing the molten ferrosilicon; front and rear sprockets; a chain device rotated by a caterpillar by a driving device; a plurality of sets of metal molds seated on the chain device in series and receiving molten ferrosilicon supplied through the distributor; a cooling device disposed on the upper surface of the chain device to cool the sets of metal molds and ferrosilicon placed inside the sets of metal molds; and a dryer disposed on the lower surface of the chain device to cool the sets of metal molds before entering the distributor, wherein ferrosilicon solidified in the sets of metal molds is discharged through the front sprocket.

In addition, Patent Document 3 (Korean Patent No. 10-1754067, "MOLD, SETS OF MOLDS, AND CASTING APPARATUS") is another related document.

Patent Document 3 provides a mold, sets of molds, and a casting apparatus, which are capable of easily discharging ferrosilicon or ferromanganese without generating condensation.

The casting apparatus according to Patent Document 3 includes a distributor for distributing molten ferrosilicon or ferromanganese; a mold part assembly including a plurality of sets of molds for receiving molten ferrosilicon or ferromanganese from the distributor; and a conveying part for conveying the mold part through closed-loop circulation passing through first and second curved sections. In this case, ferrosilicon or ferromanganese cooled in the mold part is discharged through the first curved section.

In addition, in Patent Document 3, the set of molds includes a mold holder; a plurality of molds coupled to the mold holder; and fixing parts disposed at both ends of a connection bar to fix the molds. In this case, a cavity is formed in the center of the mold, and the mold is made of a stone material.

These existing patented technologies have made great strides in a process of crushing subsidiary raw materials. However, a technology for making subsidiary raw materials have a certain unit size in a casting mold and a technology for easily separating subsidiary raw materials having a certain unit size from each other are required.

In addition, there is demand for a technique capable of solving the problem that molten subsidiary raw materials leak between molds. In addition, it is necessary to automate a process of removing subsidiary raw materials which have not been separated from a mold.

PRIOR ART DOCUMENTS

Patent Documents

[Patent Document 1] Korean Patent No. 10-1739510
[Patent Document 2] Korean Patent No. 10-1587280
[Patent Document 3] Korean Patent No. 10-1754067

DISCLOSURE

Technical Problem

Therefore, the present invention has been made in view of the above problems, and it is one object of the present invention to provide a non-crushing casting system, and the present invention provides the following problems to be solved.

First, when subsidiary raw materials having a unit size are cast on molds for casting the subsidiary raw materials, the cast subsidiary raw materials are capable of being separated.

Second, when subsidiary raw materials having a unit size are cast on molds for casting the subsidiary raw materials, the cast subsidiary raw materials have a uniform size.

Third, melted subsidiary raw materials are prevented from entering a gap between molds.

Fourth, cast subsidiary raw materials are easily detached from molds.

The technical problems that are intended to be addressed in the present invention are not restricted to the above described problems, and other problems, which are not mentioned herein, could be clearly understood by those of ordinary skill in the art from details described below.

Technical Solution

In accordance with one aspect of the present invention, provided is a non-crushing casting system.

The non-crushing casting system of the present invention includes mold units for receiving a molten material from a melting furnace and casting the molten material to form a plurality of unit shape materials having a predetermined size; and a conveyor unit for performing infinite looping so that the unit shape materials of the molten material cast in the mold units are detached, and for conveying and discharging the detached unit shape materials.

According to the non-crushing casting system of the present invention, the mold unit may include a mold frame part forming a body of the mold unit and including a plurality of cavities, wherein the upper part of each of the cavities is formed to be open and the lower part of each of the cavities is formed to be concave; covering parts disposed at the back face of the mold frame part, wherein the upper part of each of the covering parts protrudes further upward and backward than the upper part of the mold frame part; and hinders disposed at the front face of the mold frame part, wherein the upper part of each of hinders protrudes further upward than the upper part of the mold frame part.

According to the non-crushing casting system of the present invention, the covering part may include covering walls provided at the back face of the mold frame part to cover the back face of the mold frame part; and covering heads provided at the upper parts of the covering walls and formed to protrude further upward than the upper part of the mold frame part while protruding backward toward the back face of the mold frame part, and the hiding part may include hiding walls provided at the front face of the mold frame part to cover the front face of the mold frame part; and hiding heads provided at the upper parts of the hiding walls and formed to protrude further upward than the upper part of the mold frame part.

According to the non-crushing casting system of the present invention, the covering parts and the hiding parts may be formed of a copper alloy, and when the covering parts and the hiding parts are selectively pre-heated, the mold frame part may be prevented from being damaged by heat.

According to non-crushing casting system of the present invention, the conveyor unit may include a mold conveying part for performing infinite looping in a caterpillar shape so that the unit shape materials placed and cast in the cavities of the mold frame part are conveyed forward, flipped over, and detached downwardly; and a belt conveying part for receiving the unit shape materials downwardly detached by the mold conveying part and conveying the unit shape materials.

According to the non-crushing casting system of the present invention, in the mold conveying part, an upward slope may be formed in a direction in which the mold frame part containing the molten material moves forward, and, in the adjacent mold frame parts, a front-arranged mold frame part may be disposed higher than a rear-arranged mold frame part, so that the covering head of the front-arranged mold frame part covers the hiding head of the rear-arranged mold frame part to prevent a molten material flowing from the upper part of the front-arranged mold frame part to the rear-arranged mold frame part from entering a gap between the front-arranged mold frame part and the rear-arranged mold frame part.

According to the non-crushing casting system of the present invention, in the conveyor unit, a part of the mold conveying part and a part of the belt conveying part may be arranged to be spaced apart from each other in parallel.

According to the non-crushing casting system of the present invention, the mold unit may include hitting frames disposed on both sides of the mold frame part; and a plurality of hitting bars formed to protrude from the hitting frames.

According to the non-crushing casting system of the present invention, the conveyor unit may include an impact bar disposed at a lower part of the mold frame part to hit the hitting bars in turn as the hitting bars move.

According to the non-crushing casting system of the present invention, one side of the impact bar may be resiliently connected via a hinge connection, and the elastic force may cause the other side of the impact bar to apply pressure to a moving path of the hitting bars, and, when the hitting bars are discontinuously moved as the mold conveying part performs infinite looping, impact due to the elastic force may be applied to the hitting bars.

Advantageous Effects

The non-crushing casting system of the present invention having the above-described configuration provides the following effects.

First, compared to a method of crushing a subsidiary raw material for steel manufacture, the present invention can prevent environmental pollution caused by generation of dust.

Second, loss of a subsidiary raw material for steel manufacture generated in a crushing process can be reduced up to 40%. Thus, most of the subsidiary raw material can be used in a steel manufacturing process.

Third, since subsidiary raw materials are cast to form a plurality of unit shape materials, the subsidiary raw materials can be added quantitatively in a steel manufacturing process.

Fourth, unit shape materials can be detached in a separated state without sticking to each other.

Fifth, by introducing hitting bars, undetached unit shape materials can be detached.

Sixth, an edge portion of a mold unit, which is made of a graphite material, can be prevented from being damaged by heat, and equipment breakage due to inflow of a molten material between mold units can be prevented.

The effects of the present invention are not limited to those mentioned above, and other effects not mentioned can be clearly understood by those skilled in the art from the following description.

BEST MODE

Since the present invention may be applied with various modifications and may have various embodiments, exemplary embodiments and drawings of the present invention are intended to be explained and exemplified. However, these exemplary embodiments and drawings are not intended to limit the embodiments of the present invention to particular modes of practice, and all changes, equivalents, and substitutes that do not depart from the spirit and technical scope of the present invention should be understood as being encompassed in the present invention.

Figure 1:
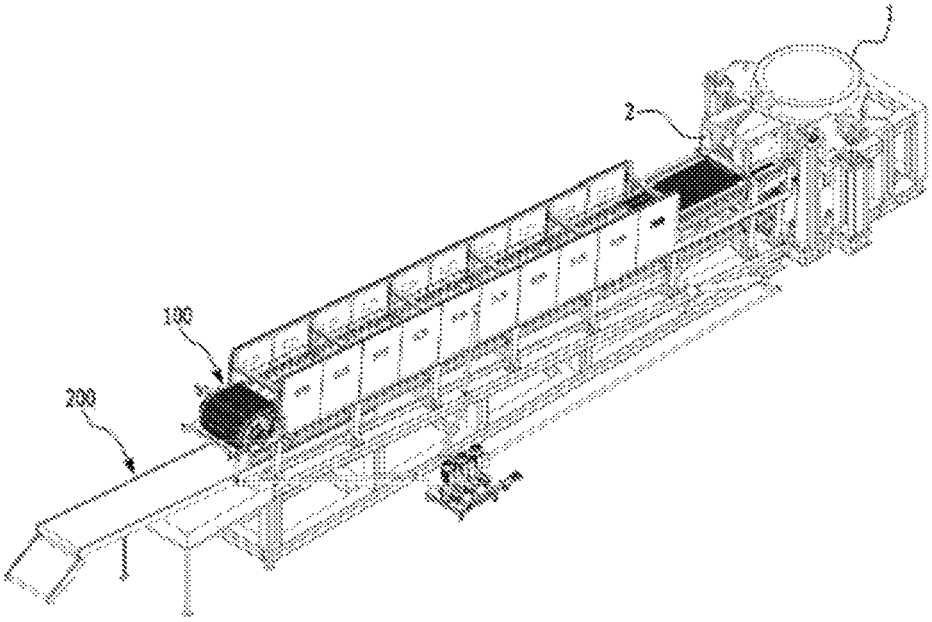
FIG. 1 is a perspective view of the left upper part of a non-crushing casting system according to one embodiment of the present invention.
Figure 2:
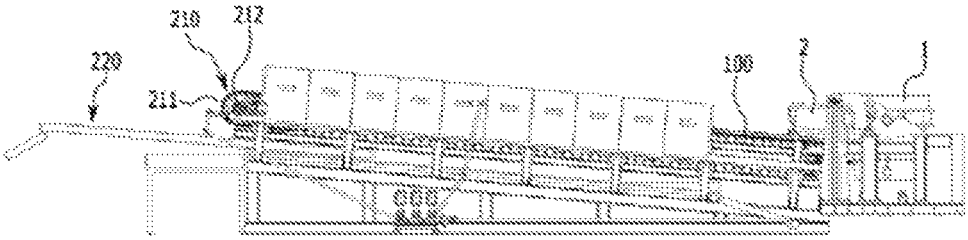
FIG. 2 is a side view of a non-crushing casting system according to one embodiment of the present invention.
Figure 3:
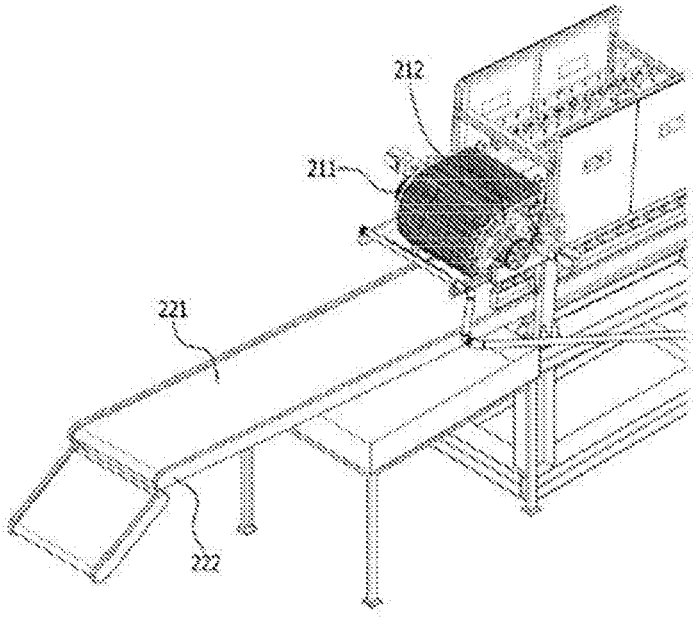
FIG. 3 is a perspective view of a part of the left upper part of a non-crushing casting system according to one embodiment of the present invention.
Figure 4:
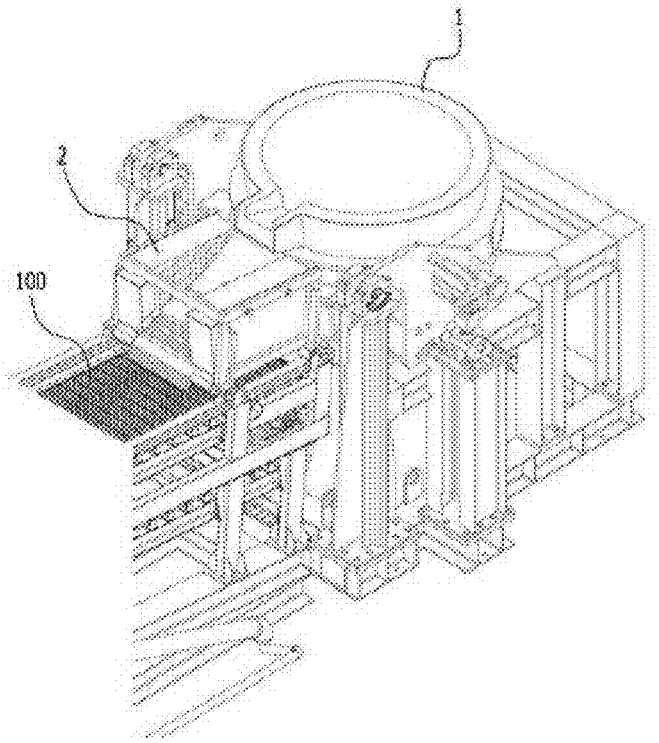
FIG. 4 is a perspective view of a part of the right upper part of a non-crushing casting system according to one embodiment of the present invention.
Figure 5:
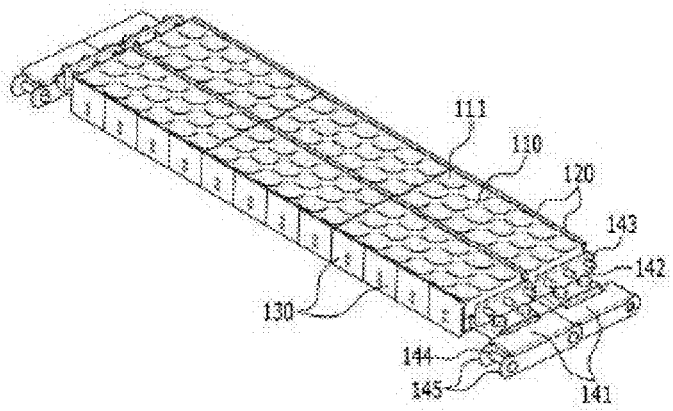
FIG. 5 is a perspective view showing that two mold units, which are components of a non-crushing casting system according to one embodiment of the present invention, are being continuously conveyed.
Figure 6:
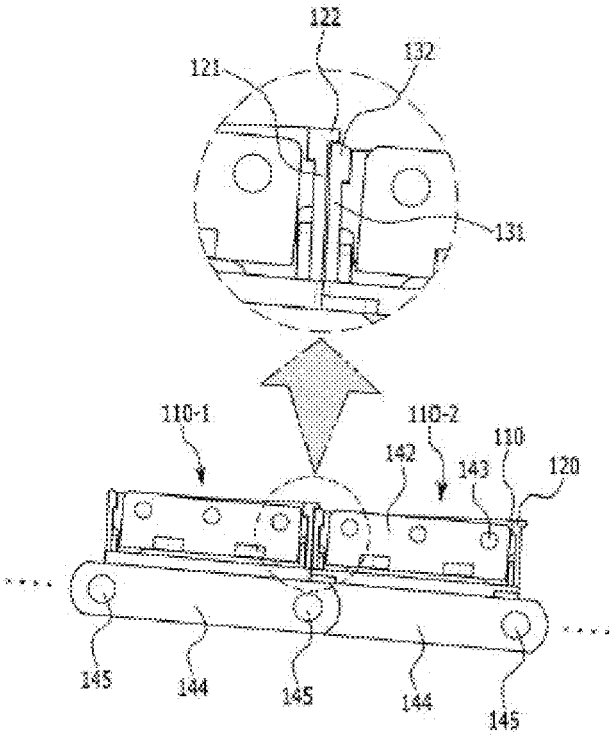
FIG. 6 is a side view showing that two mold units, which are components of a non-crushing casting system according to one embodiment of the present invention, are being continuously conveyed.
Figure 7:
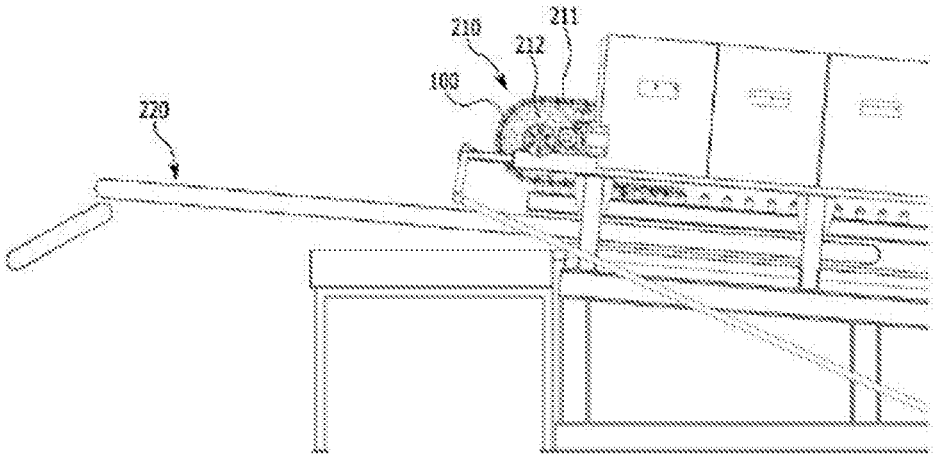
FIG. 7 is an enlarged view of a part of one side of a non-crushing casting system according to one embodiment of the present invention, showing that a mold conveying part and a belt conveying part included in a conveyor unit of the non-crushing casting system are arranged in parallel.
Figure 8:
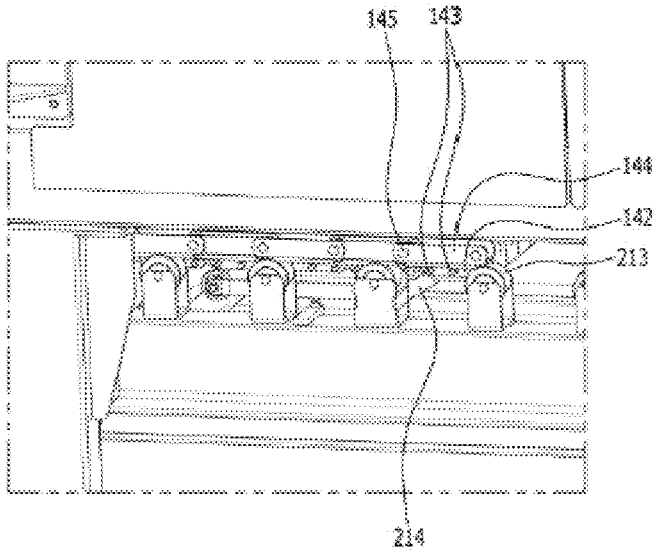
FIG. 8 illustrates a part of the lower part of a conveyor unit of a non-crushing casting system according to one embodiment of the present invention.

FIG. 1 is a perspective view of the left upper part of a non-crushing casting system according to one embodiment of the present invention. FIG. 2 is a side view of the non-crushing casting system according to one embodiment of the present invention. FIG. 3 is a perspective view of a part of the left upper part of the non-crushing casting system according to one embodiment of the present invention. FIG. 4 is a perspective view of a part of the right upper part of the non-crushing casting system according to one embodiment of the present invention. FIG. 5 is a perspective view showing that two mold units, which are components of a non-crushing casting system according to one embodiment of the present invention, are being continuously conveyed. FIG. 6 is a side view showing that two mold units, which are components of a non-crushing casting system according to one embodiment of the present invention, are being continuously conveyed. FIG. 7 is an enlarged view of a part of one side of a non-crushing casting system according to one embodiment of the present invention, showing that a mold conveying part and a belt conveying part included in a conveyor unit of the non-crushing casting system are arranged in parallel. FIG. 8 illustrates a part of the lower part of a conveyor unit of a non-crushing casting system according to one embodiment of the present invention.

As shown in FIGS. 1 and 2, the non-crushing casting system according to the present invention relates to an apparatus for melting and casting a subsidiary raw material, e.g., ferromanganese or ferrosilicon, used in a steel manufacturing process so that the subsidiary raw material has a certain unit size.

In a conventional method, a subsidiary raw material is melted, cooled, and crushed (i.e., broken and ground). Thereafter, fragments of less than 10 mm are discarded, and fragments of 10 mm to 50 mm are used.

When fragments of greater than 50 mm are added in a steel manufacturing process, stone may be formed and defects may be caused. In addition, fragments of less than 10 mm are oxidized in a steel manufacturing process. Accordingly, fragments greater than 50 mm or less than 10 mm are useless.

Therefore, in the case of crushing a subsidiary raw material, environmental pollution may be caused due to dust. In addition, since up to 40% of a subsidiary raw material may be discarded, the crushing method is very inefficient in terms of resource recycling, and problems such as increase in cost and decrease in price competitiveness may be caused.

On the other hand, the non-crushing casting system according to the present invention relates to an apparatus for manufacturing unit shape materials consisting of fragments having a predetermined size, e.g., 10 mm to 50 mm, by melting a subsidiary raw material in a melting furnace 1 and casting the same in a casting mold.

The present inventors have recognized the problems that have been overlooked in the existing patent documents and tried to solve the problems. Technical means for solving the problems will be described in detail below.

As shown in FIGS. 1 and 2, the non-crushing casting system according to the present invention may include mold units 100 and a conveyor unit 200.

As shown in FIGS. 1 to 5, the mold units 100 are configured to receive a molten material, e.g., ferrosilicon or ferromanganese, from the melting furnace 1.

As shown in FIG. 6, the mold units 100 serve to cast a molten material to form a plurality of unit shape materials having a predetermined size.

The detailed functional characteristics of the mold units 100 and configurations for expressing these characteristics will be described later.

The conveyor unit 200 has a shape of a caterpillar, i.e., a shape of a continuous track. A part of the conveyor unit 200, on which the mold units 100 are connected in series as described above, moves along a caterpillar (i.e., performs infinite looping), and another part of the conveyor unit 200 receives a cast unit shape material from the mold units 100, and conveys the cast unit shape material to the outside.

That is, the conveyor unit 200 performs infinite looping to detach a plurality of unit shape materials of a molten material, and conveys and discharges the detached unit shape materials.

As shown in FIG. 4, in the non-crushing casting system according to the present invention, each of the mold units 100 may include a mold frame part 110, covering parts 120, and hiding parts 130.

The mold frame part 110 corresponds to the body of the mold unit 100, and includes a plurality of cavities 111. In the cavities 111, as described above, casting of a molten material is performed to form unit shape materials.

The upper part of each of the cavities 111 of the mold frame part 110 is formed to be open and the lower part of each of the cavities 111 is formed to be concave so that each of the cavities 111 is filled with a molten material supplied from the melting furnace 1. Unit shape materials formed in the cavities 111 are used as unit lumps of a subsidiary raw material necessary in a steel manufacturing process. Preferably, the unit lumps have a diameter of 10 to 50 mm.

As shown in FIGS. 5 and 6, the covering parts 120 are disposed at the back face of the mold frame part 110, and the upper part of each of the covering parts 120 protrudes further upward than the upper part of the mold frame part 110 while protruding backward.

Here, a front face means a direction in which the mold frame part 110 is conveyed forward by the conveyor unit 200, and a back face means a direction opposite to the above direction.

The hiding parts 130 are disposed at the front face of the mold frame part 110, and the upper part of each of the hiding parts 130 protrudes further upward than the upper part of the mold frame part 110. In this case, the extent of the upward protrusion of the hiding parts 130 is less than the extent of the upward protrusion of the covering parts 120 described above.

As shown in FIG. 5, in the mold units 100, individual components arranged side by side and in contact with each other are conveyed to the conveyor unit 200 to be subjected to infinite looping.

The configuration of the mold units 100 is described in detail as follows. Each of the covering parts 120 may include covering walls 121 and covering heads 122, and each of the hinders 130 may include hiding walls 131 and hiding heads 132.

As shown in FIGS. 5 and 6, the covering walls 121 are provided at the back face of the mold frame part 110 to cover and protect the back face of the mold frame part 110.

The covering walls 121 are formed to have a plate shape, and the back surfaces of the covering walls 121 are in contact with the hiding walls 131 disposed on the front faces of another mold frame part 110.

The covering heads 122 are provided at the upper parts of the covering walls 121, and protrude further upward than the upper part of the mold frame part 110 while protruding backward toward the back face of the mold frame part 110.

The hiding parts 130 include the hiding walls 131. The hiding walls 131 are provided at the front face of the mold frame part 110 to cover the front face of the mold frame part 110.

The hiding walls 131 are also formed to have a plate shape to protect the front face of the mold frame part 110.

The hiding heads 132 are provided at the upper parts of the hiding walls 131 to protrude further upward than the upper part of the mold frame part 110.

As shown in FIG. 6, a stepped pulley having a height of the mold unit 100 is preferably formed in each of the two adjacent mold units 100. As shown in FIG. 2, since the conveyor unit 200 is configured so that an upward slope is formed in a direction in which the mold units 100 move forward, the stepped pulley is necessary.

A molten material poured from the melting furnace 1 flows down from the mold units 100 ascending at an angle inclined to a left upward direction, and is placed on the following mold units 100. Then, an excess of the molten material provided on the upper part of the mold units 100 is provided in the following mold units 100, the molten material is formed to have the same shape as the upper parts of the mold units 100, and no molten material remains between the cavities 111. Accordingly, unit shape materials of a subsidiary raw material for manufacturing steel are individually separated and detached.

As shown in FIG. 6, in the adjacent mold frame parts 110, the covering heads 122 of a front-arranged mold frame part 110-1 cover the hiding heads 132 of a rear-arranged mold frame part 110-2.

According to such a configuration, as shown in FIG. 6, in the adjacent mold frame parts 110, a molten material is placed on each of the mold frame parts 110. When the frames move forward, an upward slope is formed in a moving direction of the frames. At this time, a molten material placed on the front-arranged mold frame part 110-1 flows down to the rear-arranged mold frame part 110-2. At this time, inflow of the molten material between the front-arranged mold frame part 110-1 and the rear-arranged mold frame part 110-2 is prevented.

For this purpose, as shown in FIG. 2, the conveyor unit 200 may include a mold conveying part 210 and a belt conveying part 220. These structures have high inclination angles in the direction in which the top surfaces thereof proceed.

The mold conveying part 210 performs infinite looping in a caterpillar shape so that a plurality of unit shape materials placed and cast in the cavities 111 of the mold frame part 110 are conveyed forward, and the unit shape materials are flipped over and detached downwardly.

As shown in FIG. 2, the unit shape materials downwardly detached by the mold conveying part 210 are placed in the upper surface of the belt conveying part 220, and the unit shape materials are conveyed by the belt conveying part 220 to a desired location and discharged.

As shown in FIG. 7, in the conveyor unit 200, a part of the mold conveying part 210 and a part of the belt conveying part 220 are preferably arranged to be spaced apart from each other in parallel.

Referring to FIG. 7, a part of the upper left part of the mold conveying part 210 and a part of the lower right part of the belt conveying part 220 are arranged to face each other in parallel. This arrangement has important implications.

A casted subsidiary raw material, which is a unit shape material, placed in the cavities 111 of the mold frame part 110 of the mold units 100, which is conveyed by the mold conveying part 210, is often not detached downwardly from the cavities 111 due to various causes.

In this case, the mold frame part 110 downwardly rotating about a first stroke 212 of the upper left part of the mold conveying part 210 is paused at regular intervals so that the subsidiary raw material is detached downwardly.

In addition, the mold units 100 preferably include hitting frames 142 and a plurality of hitting bars 143.

As shown in FIG. 5, the hitting frames 142 are a type of a plate, and are formed to be spaced apart from both sides of the mold frame part 110.

The hitting bars 143 are formed to protrude from the hitting frames 142.

Preferably, the hitting bars 143 protrude vertically from the hitting frames 142, and are arranged at regular intervals.

As shown in FIG. 8, the conveyor unit 200 may include an impact bar 214. The impact bar 214 is disposed at a lower part of the mold conveying part 210, and is configured to hit the hitting bars 143.

As shown in FIG. 8, as the hitting bars 143 move, the impact bar 214 hits the moving hitting bars 143 in turn. At this time, due to the applied impact, vibration is applied to the mold frame part 110 positioned downward, and a casted subsidiary raw material remaining in the mold frame part 110 positioned downward is detached downwardly.

As shown in FIG. 8, one side of the impact bar 214 is resiliently connected via a hinge connection (not shown), and the elastic force causes the other side of the impact bar 214 to apply pressure to the moving path of the hitting bars 143. Accordingly, when the hitting bars 143 are discontinuously moved as the mold conveying part 210 performs infinite looping, the impact bar 214 impacts the hitting bars 143 to completely remove a subsidiary raw material remaining in the mold frame part 110.

As shown in FIGS. 2 and 7, residues present in the mold frame part 110 positioned downward fall into the area of the belt conveying part 220 by impact of the impact bar 214, and are then discharged.

The scope of the present invention is defined by the claims, and the parentheses used in the claims are not used for the purpose of limitation, but are used to specify the components. In addition, description in parentheses should be interpreted as an essential component.

| [Description of Symbols] | |
|---|---|
| 1: MELTING FURNACE | 2: RUNNER |
| 100: MOLD UNITS | 110: MOLD FRAME PART |
| 111: CAVITIES | 120: COVERING PARTS |
| 121: COVERING WALLS | 122: COVERING HEADS |
| 130: HIDING PARTS | 131: HIDING WALLS |
| 132: HIDING HEADS | 140: CHAIN PART |
| 141: HOLDING FRAME | 142: HITTING FRAME |
| 143: HITTING BARS | 144: PIN |
| 145: PLATE | 200: CONVEYOR UNIT |
| 210: MOLD CONVEYING PART | 211: CHAIN |
| 212: FIRST STROKE | 213: SUPPORTING ROLLER |
| 214: IMPACT BAR | 220: BELT CONVEYING PART |
| 221: BELT | 222: SECOND STROKE |

The invention claimed is:

1. A non-crushing casting system, comprising:

mold units for receiving a molten material from a melting furnace and casting the molten material to form a plurality of unit shape materials having a predetermined size; and a conveyor unit for performing infinite looping so that the unit shape materials of the molten material cast in the mold units are detached, and for conveying and discharging the detached unit shape materials, wherein the mold unit includes:

a mold frame part forming a body of the mold unit and having a plurality of cavities, wherein an upper part of each of the cavities is formed to be open and a lower part of each of the cavities is formed to be concave;

covering parts disposed at a back face of the mold frame part, wherein an upper part of each of the covering parts protrudes farther upward and backward than an upper part of the mold frame part; and hinders disposed at a front face of the mold frame part, wherein an upper part of each of the hinders protrudes farther upward than the upper part of the mold frame part.

2. The non-crushing casting system according to claim 1, wherein the covering part comprises covering walls provided at a back face of the mold frame part to cover the back face of the mold frame part; and covering heads provided at upper parts of the covering walls and formed to protrude farther upward than the upper part of the mold frame part while protruding backward toward a back face of the mold frame part, and a hiding part comprises hiding walls provided at a front face of the mold frame part to cover the front face of the mold frame part; and hiding heads provided at upper parts of the hiding walls and formed to protrude farther upward than the upper part of the mold frame part.

3. The non-crushing casting system according to claim 2, wherein the conveyor unit comprises a mold conveying part for performing infinite looping in a caterpillar shape so that the unit shape materials placed and cast in the cavities of the mold frame part are conveyed forward, flipped over, and detached downwardly; and a belt conveying part for receiving the unit shape materials downwardly detached by the mold conveying part and conveying the unit shape materials.

4. The non-crushing casting system according to claim 3, wherein:

in the mold conveying part, an upward slope is formed in a direction in which the mold frame part containing the molten material moves forward, and in adjacent mold frame parts, a front-arranged mold frame part is disposed higher than a rear-arranged mold frame part, so that the covering head of the front-arranged mold frame part covers a hiding head of the rear-arranged mold frame part to prevent a molten material flowing from an upper part of the front-arranged mold frame part to the rear-arranged mold frame part from entering a gap between the front-arranged mold frame part and the rear-arranged mold frame part.

5. The non-crushing casting system according to claim 3, wherein, in the conveyor unit, a part of the mold conveying part and a part of the belt conveying part are arranged to be spaced apart from each other in parallel.

6. The non-crushing casting system according to claim 5, wherein:

the mold unit comprises hitting frames disposed on both sides of the mold frame part; and a plurality of hitting bars formed to protrude from the hitting frames.

7. The non-crushing casting system according to claim 6, wherein the conveyor unit comprises an impact bar disposed at a lower part of the mold frame part to hit the hitting bars in turn as the hitting bars move.

8. The non-crushing casting system according to claim 7, wherein:

one side of the impact bar is connected via a hinge connection, and the elastic force causes another side of the impact bar to apply pressure to a moving path of the hitting bars, and when the hitting bars are discontinuously moved as the mold conveying part performs infinite looping, impact due to the elastic force is applied to the hitting bars.

9. The non-crushing casting system according to claim 1, wherein the covering parts and hiding parts are formed of a copper alloy, and when the covering parts and the hiding parts are heated, the mold frame part is prevented from being damaged by heat.

* * * * *